United States Patent [19]

Usami

[11] 4,170,479

[45] Oct. 9, 1979

[54] MULTI-LAYER COLOR LIGHT-SENSITIVE MATERIAL

[75] Inventor: Toshimasa Usami, Minami-ashigara, Japan

[73] Assignee: Fuji Photo Film Co., Ltd., Minami-ashigara, Japan

[21] Appl. No.: 647,544

[22] Filed: Jan. 8, 1976

[30] Foreign Application Priority Data

Jan. 8, 1975 [JP] Japan ..... 50-5179

[51] Int. Cl.[2] ..... G03C 1/76; G03C 3/00; G03C 7/00

[52] U.S. Cl. ..... 96/68; 96/74; 96/56.5

[58] Field of Search ..... 96/68, 74, 100, 56.5

[56] References Cited

U.S. PATENT DOCUMENTS

| | | | |
|---|---|---|---|
| 3,148,062 | 9/1964 | Whitmore et al. | 96/100 |
| 3,227,554 | 1/1966 | Barr et al. | 96/100 |
| 3,516,831 | 6/1970 | Wolf et al. | 96/74 |
| 3,617,291 | 11/1971 | Sawdey | 96/56.5 |
| 3,622,328 | 11/1971 | Pollet et al. | 96/100 |
| 3,676,141 | 7/1972 | Hara et al. | 96/100 |
| 3,726,681 | 4/1973 | Paukow et al. | 96/74 |
| 3,811,890 | 5/1974 | Ohta et al. | 96/74 |
| 3,933,500 | 1/1976 | Shiba et al. | 96/74 |

FOREIGN PATENT DOCUMENTS

| | | | |
|---|---|---|---|
| 923045 | 4/1963 | United Kingdom | 96/74 |

OTHER PUBLICATIONS

On the Mechanism of Interimage Effect-Meissner Photographic Sci. and Engr., vol. 13, No. 3, May-Jun. 1969, pp. 141-143.

DIR Couplers in Color Photography-Barr et al., Photogrphic, Sci. and Engr., vol. 13, No. 2, Mar., Apr., 1969, pp. 74-80.

DIR Couplers in Color Photography-Barr et al., Photographic Sci. and Engr., vol. 13, No. 4, Jul.-Aug. 1969, pp. 214-217.

Stabilization of Photographic Silver Halide Emulsions, Birr, Focal Press, N.Y., N.Y. ©1974, pp. 115-122.

*Primary Examiner*—Travis Brown

*Assistant Examiner*—L. Falasco

*Attorney, Agent, or Firm*—Sughrue, Rothwell, Mion, Zinn and Macpeak

[57] ABSTRACT

A multi-layer color light-sensitive material comprising at least one silver halide emulsion layer which comprises at least two unit emulsion layers, one of which is a relatively more sensitive unit emulsion layer and one of which a relatively less sensitive unit emulsion layer, the at least two unit emulsion layers being sensitive to the same spectral region, wherein the less sensitive unit emulsion layer contains a slow coupling coupler and the more sensitive unit emulsion layer contains a rapid coupling coupler and a slow coupling coupler in an amount of from about 20 to about 90 mol% based on the total coupler amount in the more sensitive unit emulsion layer.

22 Claims, No Drawings

MULTI-LAYER COLOR LIGHT-SENSITIVE MATERIAL

BACKGROUND OF THE INVENTION

1. Field of the Invention

The present invention relates to a multi-layer color light-sensitive material and, more particularly, to an improved multi-color light-sensitive material wherein at least one silver halide light-sensitive layer containing a dye image-forming coupler comprises a plurality of silver halide unit emulsion layers.

2. Description of the Prior Art

As is well known, multi-layer color light-sensitive materials comprise a support such as cellulose ester, polyester or paper having coated thereon light-sensitive layers such as a red-sensitive silver halide emulsion layer containing a diffusion-resistant cyan image-forming coupler, a green-sensitive silver halide emulsion layer containing a diffusion-resistant magenta image-forming coupler and a blue-sensitive silver halide emulsion layer containing a diffusion-resistant yellow image-forming coupler, the coating order of these light-sensitive layers varying depending upon the end use thereof.

British Pat. No. 818,687 suggests to raise the sensitivity of a multi-layer color light-sensitive material by using at least one emulsion layer which comprises two unit emulsion layers, one a less sensitive unit emulsion layer and one a more sensitive unit emulsion layer, the former being nearer to a support and the latter being provided thereon. In this case, the two unit emulsion layers contain couplers in the same concentration and are sensitized to the same spectral region. However, this type of light-sensitive material involves the disadvantage that the graininess of color images is coarse, though sensitivity is somewhat imcreased.

In order to remove this disadvantage, British Pat. No. 923,045 suggests graininess can be improved by the more sensitive unit emulsion layer (coarse graininess layer) providing a much lower density than that of the less sensitive unit emulsion layer. With this improvement, however, sensitivity is not sufficiently raised and the degree of fineness of grains is not sufficient.

U.S. Pat. No. 3,516,831 teaches that to improve the sharpness of color images a 4-equivalent coupler is incorporated in the more sensitive unit emulsion layer and a 2-equivalent coupler is incorporated in the less sensitive unit emulsion layer, the two unit emulsion layers constituting one emulsion layer and being sensitive to at least one spectral region which is the same. However, the defect is encountered that color fog is caused in unexposed areas due to the 2-equivalent coupler.

Furthermore, U.S. Pat. No. 3,726,681 teaches raising the sensitivity and making the grains finer by incorporating a rapid coupling coupler in the more sensitive unit emulsion layer and a slow coupling coupler in the less sensitive unit emulsion layer, the two unit emulsion layer constituting one emulsion layer and being sensitive to at least one spectral region which is the same. However, this involves the disadvantage that color fog is caused by the rapid coupling coupler in the more sensitive unit emulsion layer.

SUMMARY OF THE INVENTION

One object of the present invention is to provide a multi-layer color light-sensitive material in which color fog is controlled and which provides high sensitivity, improved graininess and sufficient maximum color density.

Another object of the present invention is to provide a multi-layer color light-sensitive material having excellent color separation and improved image sharpness.

A further object of the present invention is to provide a process for preparing a multi-layer color light-sensitive material as described above.

Still a further object of the present invention is to provide an image-forming process using the above-described multi-layer color light-sensitive material.

These and other objects of the present invention will become apparent from the following description of the invention.

The above-described objects of the present invention have been attained by the use of a multi-layer color light-sensitive material in which at least one silver halide emulsion layer comprises at least two unit emulsion layers, one being a relatively more sensitive unit emulsion layer and one being a relatively less sensitive unit emulsion layer and both being sensitive to the same spectral region, where the less sensitive unit emulsion layer contains (i) a slow coupling coupler and the more sensitive unit emulsion layer contains (i) a rapid coupling coupler and (ii) a slow coupling coupler in an amount of from about 20 to about 90 mol% based on the total coupler content in the more sensitive unit emulsion layer.

Furthermore, the above-described objects of the present invention are attained by the use of a multi-layer color light-sensitive material in which at least one silver halide emulsion layer comprises at least two unit emulsion layers, one being a relatively more sensitive unit emulsion layer and one being a a relatively less sensitive unit emulsion layer and both being sensitive to the same spectral region, where the less sensitive unit emulsion layer contains a (i) slow coupling coupler and the more sensitive unit emulsion layer contains (i) a rapid coupling coupler, (ii) a slow coupling coupler in an amount of from about 20 to 90 mol% based on the total coupler content in the more sensitive unit emulsion layer; and (iii) a development inhibitor-releasing (DIR) coupler and/or a development inhibitor-releasing (DIR) compound in an amount of from about 0.1 to about 40 mol% based on the total coupler content (including the DIR coupler and/or DIR compound) in the more sensitive unit emulsion layer and/or the less sensitive unit emulsion layer. In essence, the DIR coupler and/or the DIR compound can be treated as interchangeable.

DESCRIPTION OF PREFERRED EMBODIMENTS

As is described in U.S. Pat. No. 3,726,681, it is possible to raise sensitivity without making graininess coarse by separating a silver halide emulsion layer into a relatively more sensitive unit emulsion layer and a relatively less sensitive unit emulsion layer which are both sensitive to one spectral region which is the same, and by using a rapid coupling coupler in the more sensitive unit emulsion layer. However, as is well known, rapid coupling couplers have the common defect that color fog is liable to be generated therefrom.

The present invention is based upon the discovery that incorporation of a slow coupling coupler in the above-described proportions as well as a rapid coupling coupler in the more sensitive unit emulsion layer serves to remove color fog, and, surprizingly, to increase sensitivity and improve graininess, i.e., the present invention provides a multi-layer color light-sensitive material having increased sensitivity, improved graininess and less color fog.

In the more sensitive unit emulsion layer, the proportion of the slow coupling coupler based on the total coupler content including the rapid coupling coupler range from about 20 to about 90 mol%. Proportions outside this range fail to provide the effects of the present invention. A particularly preferred content of the slow coupling coupler ranges from about 30 to about 80 mol%. Further, it is possible to incorporate in the more sensitive unit emulsion layer about 20 to about 90 mol% of the slow coupling coupler, more preferably from 30 to 80 mol% of the slow coupling coupler, and about 10 to 50 mol% of the rapidly coupling coupler, the balance being of a DIR coupler and/or a DIR compound. In particular, the incorporation of a DIR coupler and/or a DIR compound in a proportion of from about 0.1 to about 40 mol% based on the total coupler content in the unit emulsion layer, which unit emulsion layer can be the more sensitive or the less sensitive unit emulsion layer, renders the effects of the present invention remarkable.

The difference in sensitivity between the more sensitive unit emulsion layer and the less sensitive unit emulsion layer of the silver halide photographic emulsion layer in accordance with the present invention ranges from about 0.1 to about 0.7 logE, preferably from 0.2 to 0.6 logE.

It is well known that the graininess of color images, which mainly depends upon a dye cloud formed upon coupling reaction around silver halide grains, is deteriorated by using a photographic emulsion of coarse silver halide grains. However, according to the present invention, the graininess of color images obtained by the total emulsion layers sensitive to the same spectral region is almost as good as that obtained using a less sensitive unit emulsion layer containing fine silver halide grains, in spite of the presence of the more sensitive emulsion layer containing coarse silver halide grains.

The rapid coupling coupler and the slow coupling coupler referred to in the present specification and claims are distinguished from each other by their relative coupling velocity (measured by the method described in, e.g., *Mitteilungen aus den Forochungslaboratorien der Agfa Leverkusen-Munchen,* vol. 3, p.81) as described in U.S. Pat. No. 3,726,681, and these couplers are not restricted by chemical structure. The coupling velocity of the rapid coupling coupler is about 2 to about 20 times, preferably 3 to 5 times, that of the slow coupling coupler.

In the present invention, at least one silver halide emulsion layer sensitive to one primary color region of the spectrum comprises a relatively more sensitive unit emulsion layer and a relatively less sensitive unit emulsion layer, and the unit emulsion layers contain color forming couplers which form dyes in substantially the same color region of the spectrum, i.e., cyan, magneta or yellow. Most preferably, as will be apparent to one skilled in the art, there is provided at least three of such silver halide emulsion layers comprising a relatively more sensitive unit emulsion layer and a relatively less sensitive emulsion layer to provide cyan, magenta, and yellow dyes.

The couplers added to the silver halide emulsion layers in accordance with the present invention (including the more sensitive unit emulsion layer or the less sensitive unit emulsion layer comprising silver halide emulsion layer) are conventional image-forming couplers, mask-forming colored couplers, development inhibitor-releasing (DIR) couplers, couplers which do not form a color and the like. In addition, development inhibitor-releasing (DIR) compounds such as DIR hydroquinones may be used in combination therewith.

As the development inhibitor-releasing (DIR) couplers, those which form substantially the same hue as that of the main coupler in the unit emulsion layer in which they are present in combination therewith are desirably selected. However, DIR couplers forming a completely different hue may also be used since it is often difficult to synthesize (DIR) couplers which have exactly the same hue as the primary coupler.

For example, a yellow-forming DIR coupler may be used in a cyan-forming layer. The molar ratio of the couplers added, based on silver halide, can differ between the more sensitive unit emulsion layer and the less sensitive unit emulsion layer. The molar ratio of silver halide: coupler ranges from about 2 to about 100 and, preferably from about 10 to about 60, in the more sensitive unit emulsion layer, and from about 3 to about 30 in the less sensitive unit emulsion layer. For generally used commercial materials which will be formed in accordance with the present invention, usually a unit emulsion layer will be from about 0.3 to about 6$\mu$ thick (wet basis), though it will be appreciated by one skilled in the art that this is not a binding limitation. Similarly, for most generally formed and used commercial materials, from about 2 to about 40 mg/100 $cm^2$ of silver will be present, though again this is not a binding limitation.

As the rapid coupling couplers referred to in the present specification and claims, the selection of compounds which are preferred from the viewpoint of chemical structure and/or the method of introducing them into a emulsion layer are preferred. In general, introducing couplers by dispersing them as oil droplets is liable to slow the coupling velocity.

As rapid coupling couplers used in the present invention, couplers represented by the following general formulae are preferred.

General formula (I) (cyan coupler);

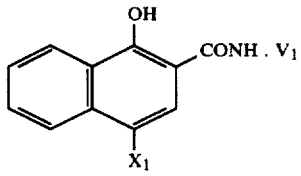

wherein $X_1$ represents a hydrogen atom, a substituted alkoxy group, preferably a substituted alkoxy group with from 1 to 22 carbon atoms, most preferably 1 to 8 carbon atoms, where preferred substituents include, for example, acyl, fluorine, chlorine, amino, etc., or a substituted aryloxy group, where preferred aryloxy groups include phenoxy and naphthoxy, $V_1$ represents an acylaminosubstituted alkyl group, where the alkyl moiety preferably has from 2 to 8 carbon atoms, or a disubstituted phenyl group

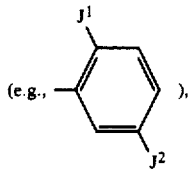

wherein $J^1$ represents a dialkylamino group, where preferred alkyl moieties therein have from 6 to 12 carbon atoms, a halogen atom or an alkoxy group, where preferred alkoxy groups have from 1 to 22 carbon atoms, $J^2$ represents a sulfo group, an N-alkylsulfamoyl group, where preferred alkyl moieties therein have from 8 to 22 carbon atoms, a carboxy group or an alkoxycarbonyl group, where preferred alkoxy moieties therein have from 8 to 22 carbon atoms, when $X_1$ represents a hydrogen atom, or $V_1$ represents an alkyl group, preferably with from 8 to 22 carbon atoms, or an aryloxyalkyl group, where a preferred aryl moiety is phenyl and preferred alkyl moieties have from 2 to 6 carbon atoms, when $X_1$ represents a substituted alkoxy group or a substituted aryloxy group as above described.

General formula (II) (magenta coupler);

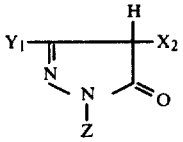

wherein $X_2$ represents a hydrogen atom or a hydroxyphenylazo group, $Z_1$ represents a substituted phenyl group free of substituents at both the 2- and 6-positions, where preferred substituents include halogen, alkyl with 1 to 5 carbon atoms and alkoxy with 1 to 5 carbon atoms, provided that when $X_2$ represents a hydroxyphenylazo group $Z_1$ can be a phenyl group having substituents at the 2- and/or 6-positions, where preferred substituents include halogen, alkyl with 1 to 5 carbon atoms and alkoxy with 1 to 5 carbon atoms, and $Y_1$ represents an alkyl group, most preferably an alkyl group with from 8 to 20 carbon atoms, an acylamino group or a substituted phenylamino group, where preferred substituents include halogen, acylamino, sulfamoyl and carbamoyl, wherein the latter three substituents preferably have from 8 to 22 carbon atoms.

General formula (III) (yellow coupler);

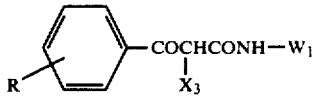

wherein $X_3$ represents a coupling off group as disclosed in, for example, German Patent Applications (OLS) 2,163,812; 2,219,917; 2,261,361; 2,263,875; and 2,423,820; preferably a hydrogen atom or a cyclic amido group, R represents an alkyl group, most preferably with from 1 to 5 carbon atoms or an alkoxy group, most preferably with from 1 to 22 carbon atoms, and $W_1$ represents a disubstituted phenyl group as follows;

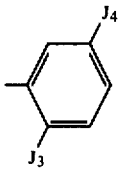

wherein $J_3$ represents a halogen atom or an alkoxy group, most preferably with from 1 to 22 carbon atoms, and $J_4$ represents a sulfo group, a carboxy group or an alkoxycarbonyl group, most preferably with from 8 to 22 carbon atoms, or, when $X_3$ represents a cyclic amido group, $J_4$ is an acylamino group, most preferably with from 8 to 22 carbon atoms.

As particularly preferred rapid coupling couplers, the following non-limitative compounds are illustrated.

Cyan Coupler

C-1

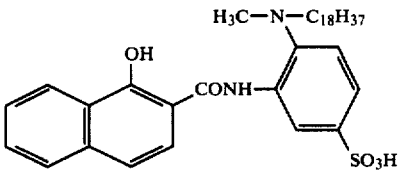

C-2

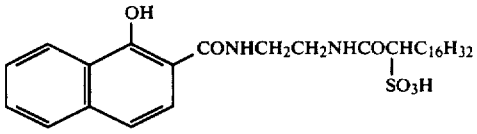

C-3

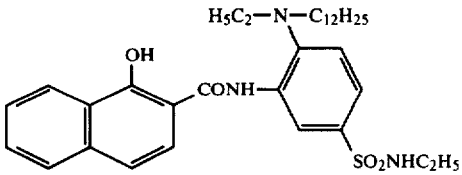

-continued
C-4
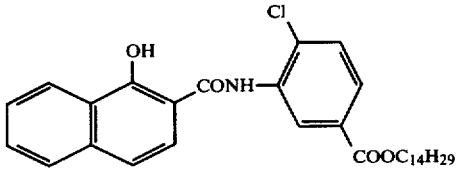
C-5
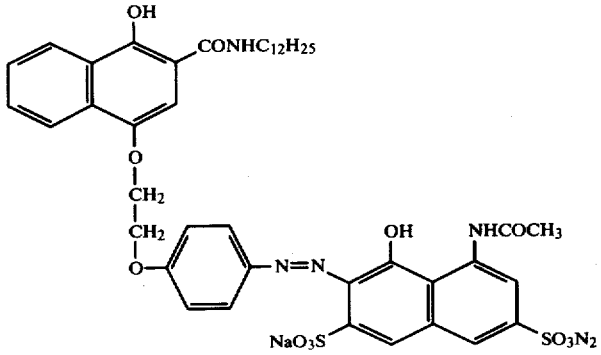
Magenta Coupler
M-1
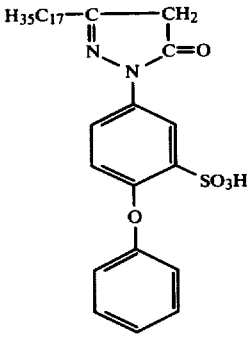
M-2
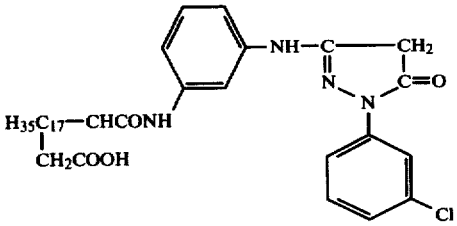
M-3
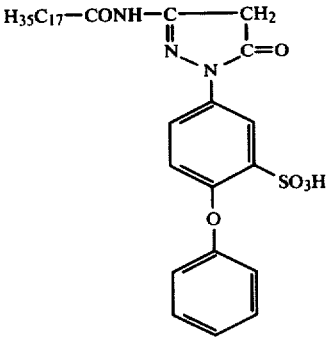

-continued

M-4

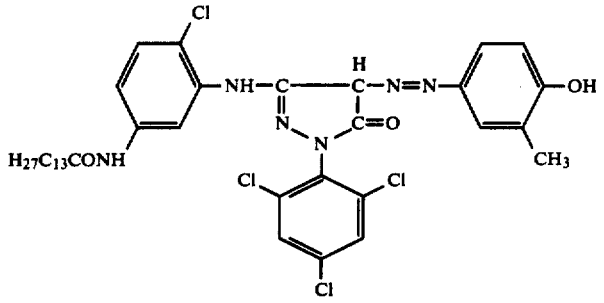

Yellow Coupler

Y-1

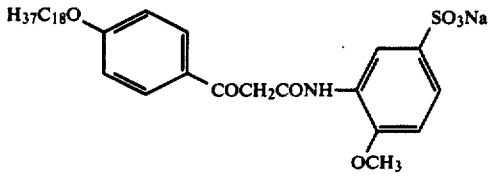

Y-2

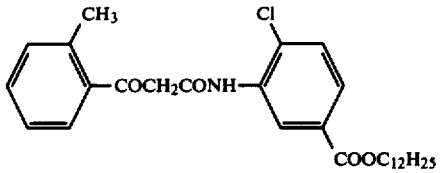

Y-3

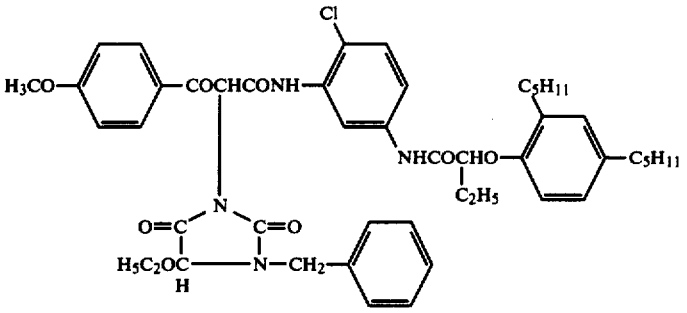

As slow coupling couplers, those represented by the following general formulae are preferred.

General formula (IV) (cyan coupler);

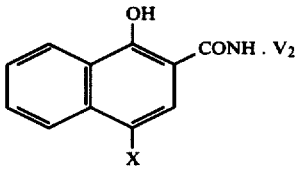

wherein $V_2$ represents an alkyl group, most preferably with from 8 to 18 carbon atoms, or an aryloxyalkyl group, with a preferred aryl moiety being phenyl and preferred alkyl moieties having from 2 to 6 carbon atoms group (e.g., a 3-(2,4-di-t-pentylphenoxy)propyl group, a 4-(2,4-di-t-pentylphenoxy)butyl group, etc.), and X represents a hydrogen atom or a halogen atom, such as Cl, Br, I.

General formula (V) (magenta coupler);

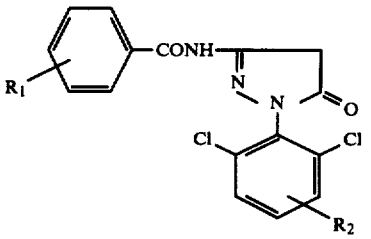

wherein $R_2$ represents a halogen atom such as Cl, a lower alkyl or a lower alkoxy group, where preferred lower alkyl groups and preferred lower alkoxy groups have from 1 to 4 carbon atoms, and $R_1$ represents an alkyl group, most preferably an alkyl group of from 8 to 18 carbon atoms, an aryloxyalkylcarbamido group, where a preferred aryl moiety is phenyl and wherein preferred alkyl moieties have from 2 to 18 carbon atoms, or an alkylamido group, where preferred alkyl groups comprise from 8 to 22 carbon atoms.

General formula (VI) (yellow coupler);

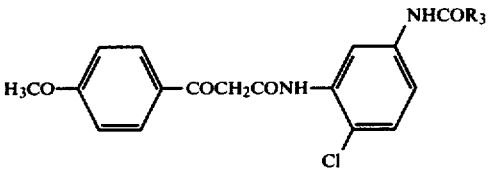

wherein $R_3$ represents an alkyl group, most preferably an alkyl group of from 7 to 22 carbon atoms, or an aryloxyalkyl group, where a preferred aryl moiety is phenyl and where preferred alkyl moieties comprise from 1 to 17 carbon atoms.

As illustrative of particularly preferred slow coupling couplers, there are the following compounds which, however, are not to be taken as limitative.

Cyan Coupler

C-6

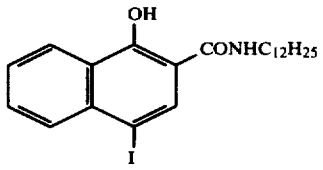

C-7

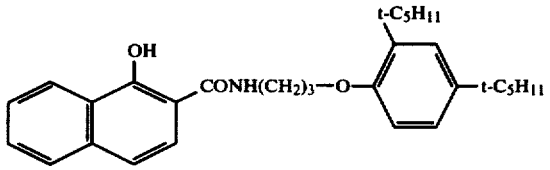

C-8

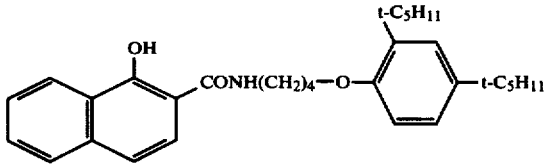

Magenta Coupler

M-4

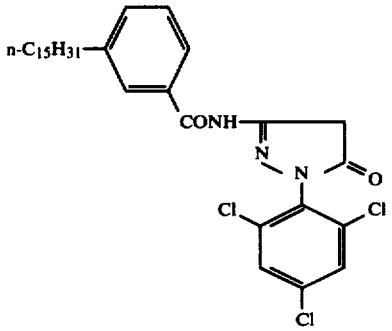

M-5

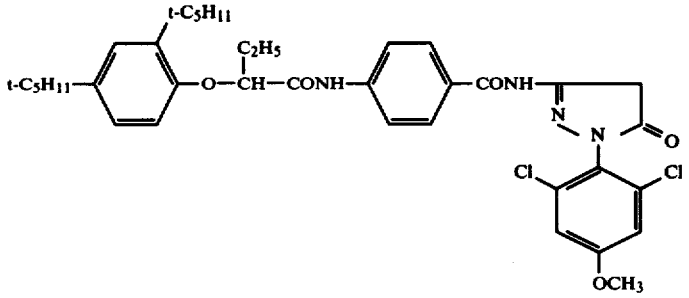

M-6

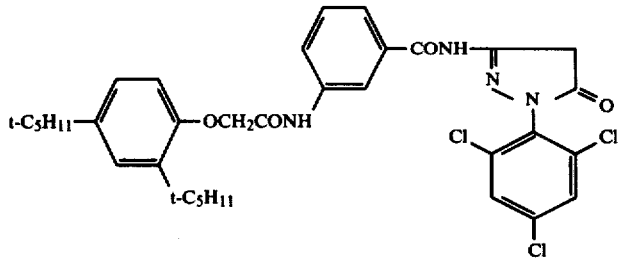

-continued

Yellow Coupler

Y-4

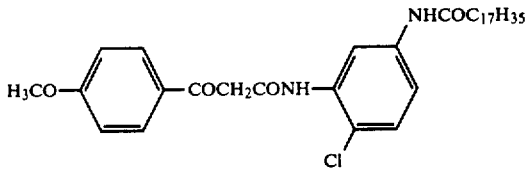

Y-5

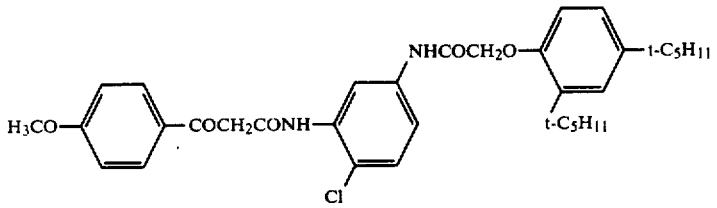

As development inhibitor-releasing (DIR) couplers, there can be used, for example, DIR yellow couplers, DIR magenta couplers and DIR cyan couplers as described in U.S. Pat. Nos. 3,227,554, 3,148,062, 3,701,783, 3,617,291, Japanese Patent Application 33,238/73 open to public inspection under No. 122,335/74 (describing DIR magenta couplers), U.S. Pat. No. 3,622,328, Japanese Patent Publication No. 28836/70, West German Patent OLS 2,163,811, etc.

Japanese Patent Application No. 33,238/73 discloses magenta couplers, wherein those represented by the following general formula (I) are particularly useful;

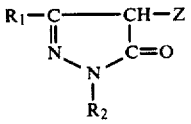

(I)

wherein $R_1$ represents an alkyl group (e.g., having 1 to 18 carbon atoms) such as a primary, secondary or tertiary alkyl group (e.g., methyl, propyl, n-butyl, t-butyl, hexyl, 2-hydroxyethyl, 2-phenylethyl, etc.), an aryl group (e.g., phenyl, tolyl, m-acylaminophenyl, etc., an alkoxy group (e.g., methoxy, ethoxy, benxyloxy, etc.), an aryloxy group (e.g., phenoxy, 3,3'-dialkoxycarbonylphenyoxy, etc.) a hetero ring (e.g., quinolinyl, pyridyl, piperidyl, benzofuranyl, oxazolyl, etc.), an amino group (e.g., methylamino, diethylamino, dibutylamino, phenylamino, tolylamino, 4-(3-sulfobenzamino)anilino, 2-chloro-5-acylaminoanilino, 2-chloro-5-alkoxycarbonylanilino, 2-trifluoromethylphenylamino, etc.), a carbonamido group (e.g., alkylcarbonamido, arylcarbonamido, heterocyclicarbonamido, sulfonamido, alkylsulfonamido, arylsulfonamido, heterocyclic sulfonamido, etc.), an ureido group (e.g., alkylureido, arylureido, heterocyclic ureido, etc.), and $R_2$ represents an aryl group (e.g., naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trifluoromethylphenyl, 3,5-dibromophenyl, etc.), a heterocyclic group (e.g., benzofuranyl, naphthoxazolyl, quinolinyl, etc.), an alkyl group such as a primary, secondary or tertiary alkyl group (e.g., methyl, ethyl, t-butyl, benzyl, etc.), and the like.

Japanese Patent Application No. 28,836 discloses useful cyan-forming couplers which may be selected from compounds having the general formula:

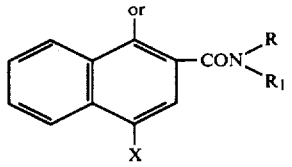

wherein X is a member selected from the group consisting of an iodine atom and a bromine atom, R is a member selected from the group consisting of a hydrogen atom, an alkyl group, a substituted alkyl group, an aryl group, and a substituted aryl group, and $R_1$ is a ballasting organic radical containing at least eight carbon atoms.

The cyan-forming coupler may also be selected from compounds having the general formula:

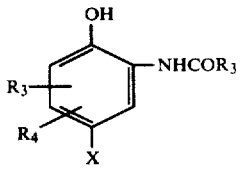

wherein X is a member selected from the group consisting of an iodine atom and a bromine atom, $R_1CO$ is an acyl group containing at least nine carbon atoms, and $R_3$ and $R_4$ are each a member selected from the group consisting of a hydrogen atom, a halogen atom and an alkyl group.

West German Pat. OLS No. 2,163,811 discloses 2-equivalent couplers having the formula:

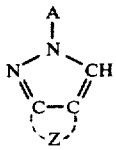

wherein A is a residue of a cyan image-forming coupler having an α-naphthol or phenol nucleus from which has been removed the hydrogen in the p-position to the hydroxyl group thereof; and Z is an atomic group necessary for forming an indazolyl group.

Preferred development inhibitor-releasing (DIR) couplers are couplers represented by the following general formulae:

General formula (VII) (DIR yellow coupler);

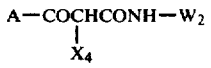

wherein A represents an aryl group, a tert-alkyl group, preferably with 4 or 5 carbon atoms, or a 1-substituted-1,1-dialkylmethyl group, where preferred alkyl moieties comprise from 1 to 4 carbon atoms; the aryl group is preferably a substituted phenyl group, where preferred substituents include an alkyl group or an alkoxy group, where most preferred alkyl groups have from 1 to 5 carbon atoms and most preferred alkoxy groups have from 1 to 22 carbon atoms, $W_2$ represents a substituted aryl group (where preferred substituents are the same as $J_3$ and $J_4$ on group $W_1$ as defined for General Formula (III), most preferably a phenyl group which is so substituted), and $X_4$ represents a group eliminated upon coupling to diffuse as a development inhibitor (preferably a heterocylicthio group as described in U.S. Pat. No. 3,227,554, for example, a 1-benzotriazolyl group, or a 5-or 6-substituted-1-benzotriazolyl group as described in German Patent Application (OLS) No. 2,441,006.

General formula (VIII) (DIR magenta coupler);

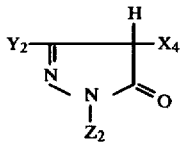

wherein $Y_2$ represents an alkyl group, most preferably as defined for $Y_1$ in General Formula (II), or a substituted amino group (e.g., a substituted arylamino group, preferably a substituted phenylamino or naphthylamino group, a cyclic amino group, most preferably a 5- or 6-membered cyclic amino group, a dialkylamino group, where preferred alkyl moieties therein comprise from 1 to 6 carbon atoms, etc.), $Z_2$ represents an aryl group, a substituted aryl group (preferably a substituted phenyl group), where preferred substituents include halogen, acylamino, sulfamoyl and carbamoyl, wherein the latter three substituents most preferably have from 8 to 22 carbon atoms, a substituted or unsubstituted aralkyl group (where preferred substituents include alkyl groups with from 1 to 4 carbon atoms, alkoxy groups with from 1 to 4 carbon atoms and halogen atoms, and wherein preferred substituted aralkyl groups are alkyl-substituted phenyl groups, most preferably a benzyl group) and $X_4$ is the same as defined in general formula (VII).

General formula (IX) (DIR cyan coupler);

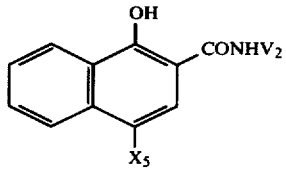

wherein $V_2$ represents a substituted aryl group (where preferred substituents include alkoxy and alkyl groups with from 8 to 22 carbon atoms, and wherein the aryl group is most preferably phenyl or naphthyl), most preferably a substituted phenyl group, a substituted aryloxyalkyl group (where preferred substituents include alkoxy and alkyl groups with from 8 to 22 carbon atoms, and wherein the aryl moiety is preferably phenyl and the alkyl moiety most preferably has from 2 to 6 carbon atoms), most preferably a substituted phenyloxyalkyl group, an alkyl group, most preferably an alkyl group with 8 to 22 carbon atoms, or the like, and $X_5$ represents a group capable of being eliminated upon coupling to diffuse as a development inhibitor (preferably a heterocyclicthio group as described in U.S. Pat. No. 3,227,554).

As particularly preferred development inhibitor-releasing (DIR) couplers, there can be illustrated the following compounds.

DIR yellow Coupler

Y-6

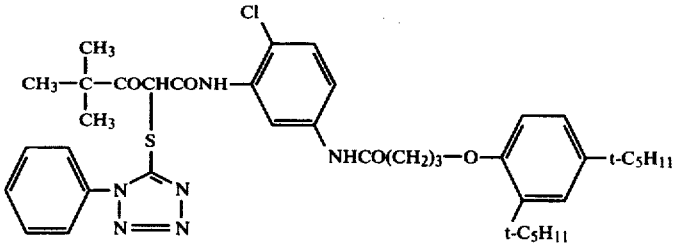

Y-7

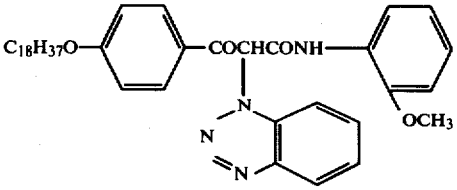

-continued
Y-8
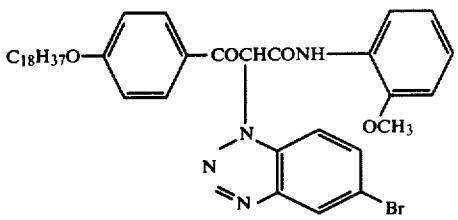
Y-9
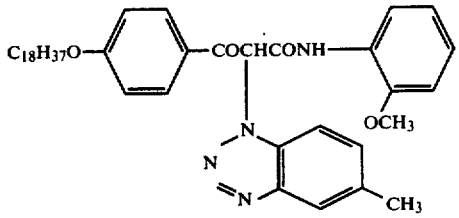
Y-10
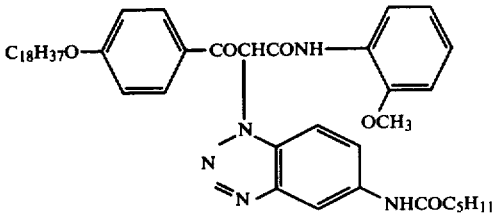
Y-11
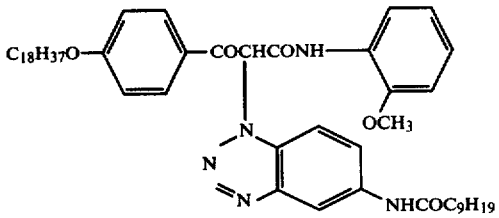
Y-12
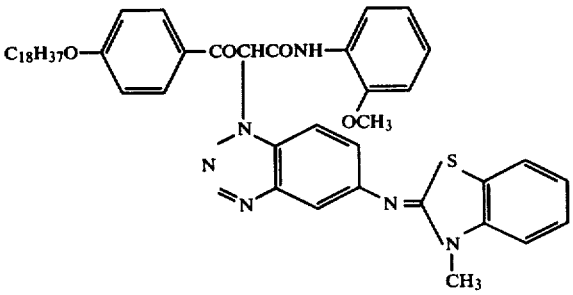
Y-13
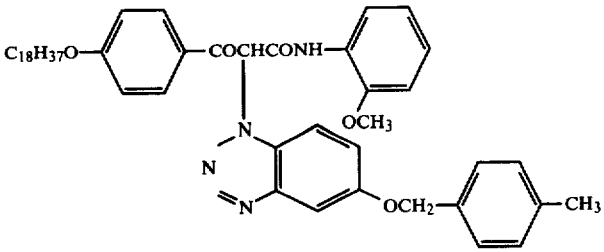

-continued
DIR magenta Coupler
M-7
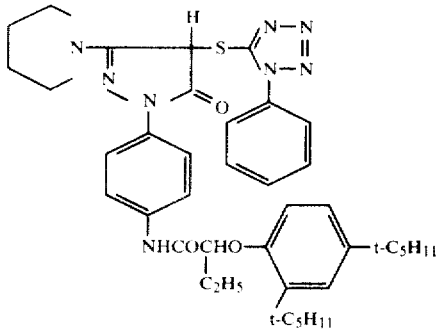
M-8
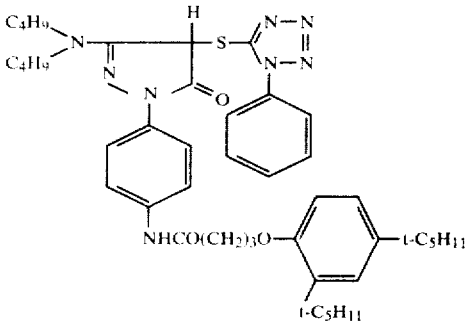
M-9
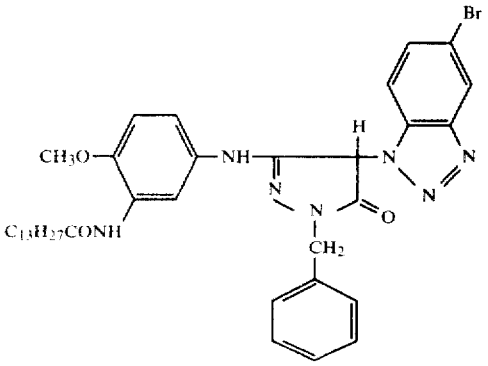
M-10
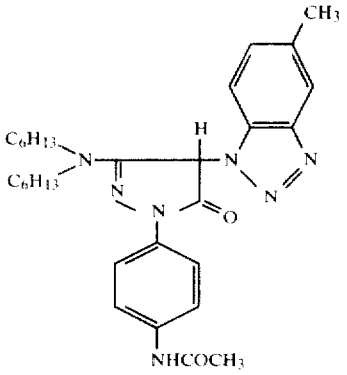

-continued

M-11

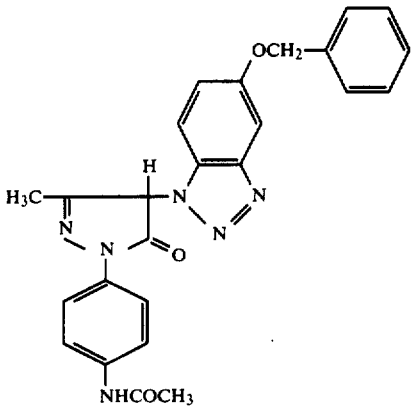

DIR Cyan Coupler

C-9

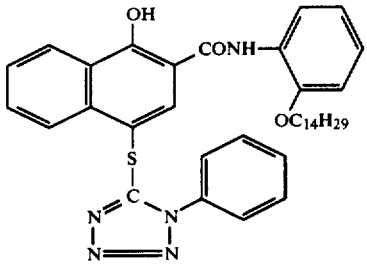

C-10

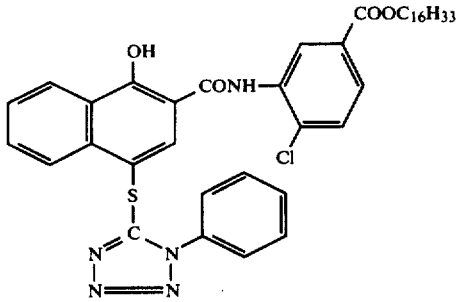

C-11

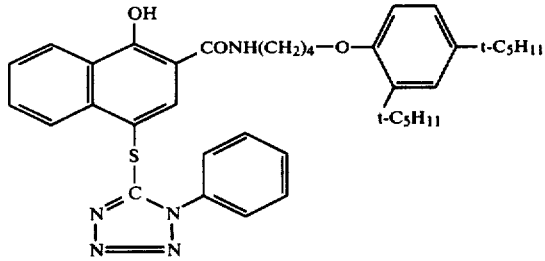

As development inhibitor-releasing (DIR) compounds, there can be used, for example, those described in U.S. Pat. Nos. 3,379,529, 3,639,417, 3,297,445, Japanese Patent Application No. (OPI) No. 37,435/75 corresponding to U.S. Pat. No. 4,105,452 to Shiba et al. (describing DIR hydroquinones), U.S. Pat. No. 3,632,345, etc.

As the preferred development inhibitor-releasing (DIR) compounds, there are illustrated the following compounds.

D-1

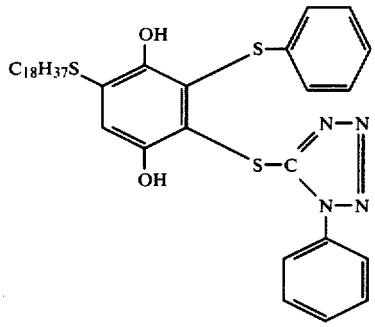

D-2

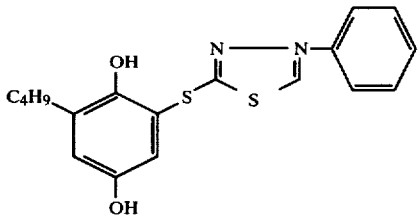

D-3

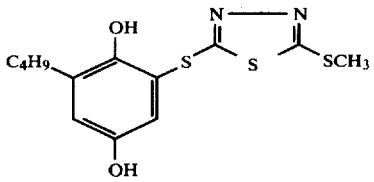

It is well known that the reactivity of couplers varies depending upon the process for dispersing the same. With an oil dispersion or a polymer dispersion where a coupler is protected by an oil or polymer, the reactivity of the coupler is generally low, whereas with an aqueous alkaline solution and a dispersion prepared by dissolving or dispersing a coupler in an aqueous alkaline solution or in a low-boiling point solvent which is removed after the formation of an emulsion layer, emulsifying and dispersing to directly add the coupler to an silver halide emulsion, high coupling velocity results.

However, since couplers have chemical structures suitable for a particular dispersing process, it is not always actually possible to apply the above-described four dispersing processes to any optionally selected coupler, and it is preferred to select a chemical structure most suitable for a given dispersing process.

Couplers used in the present invention preferably have a ballast group, and numerous examples of such couplers are described in U.S. Pat. Nos. 2,920,961, 2,875,057, 3,418,129, 3,658,544, 3,681,076, 3,062,653, 2,474,293, British Patent 1,201,943, West German Pat. (OLS) No. 2,216,578, Japanese Patent Applications (OLS) Nos. 2,418,430, 2,429,637, etc.

Yellow couplers as can be used in the present invention can be selected from among those described in U.S. Pat. Nos. 3,265,506, 3,728,658, 3,369,895, 3,582,322, 3,408,194, 3,415,652, 3,253,924, British Pat. Nos. 12,86,411, 1,040,710, 1,302,398, 1,204,680, West German Pat. (OLS) Nos. 1,956,281, 2,162,899, 2,213,461, etc.

Magenta couplers as can be used in the present invention can be selected from among those described in U.S. Pat. Nos. 2,600,788, 3,558,319, 3,468,666, 3,419,391, 3,311,476, 3,253,924, 3,311,476, British Pat. No. 1,293,640, German Pat. (OLS) No. 2,408,665, etc.

Cyan couplers which can be used in the present invention can be selected from among those described in U.S. Pat. Nos. 2,369,929, 2,474,293, 3,591,383, 2,895,826, 3,458,315, 3,311,476, 3,419,390, 3,476,563, 3,253,924 and British Pat. No. 1,201,110, etc.

Also colored couplers can be used in the photographic material of the present invention, if desired.

Colored magenta couplers as can be used are selected from among those described in U.S. Pat. Nos. 2,434,272, 3,476,564, 3,476,560, German Pat. (OLS) No. 2,418959, etc.

Colored cyan couplers as can be used are selected from among those described in U.S. Pat. Nos. 3,034,892, 3,386,301, 2,434,272, etc.

Couplers which do not form color as can be used are selected from those described in British Pat. Nos. 861,138, 914,145, 1,109,963, Japanese Patent Publication No. 14033,70, U.S. Pat. No. 3,580,722, *Mitteilungen aus den Forchungslaboratorien der Agfa Leverkusen,* Vol. 4, pp. 352–367 (1964), etc.

As the silver halide of an emulsion used in the present invention, there can be used mixed silver halides such as silver chlorobromide, silver bromoiodide, silver chlorobromoiodide, etc., as well as silver chloride and silver bromide. Silver bromoiodide containing 1 mol% to 12 mol% silver iodide is preferred. The form of the silver halide grains may be any of cubic, octahedral and mixed forms thereof and the grain size need not necessarily be uniform.

The silver halide grains can be formed by conventional processes. Of course, it is useful to prepare them according to the single- or double-jet process, the controlled double jet process, etc.

Also, two or more silver halide photographic emulsions which are separately prepared can be used by mixing them. Further, silver halide grains having a uniform structure, silver halide grains wherein the inner and the exterior parts form a different layer structure, and conversion type silver halide grains as described in British Pat. No. 635,841 and U.S. Pat. No. 3,622,318 may be used. Silver halide grains of the type forming a latent image mainly on the surface of the grains and of the type forming a latent image within grains may be used.

Useful photographic emulsions are described in Mees, *The Theory of the Photographic Process* (published by MacMillan Co.), P. Glafikides; *Chimie Photographique* (published by Paul Montel, 1957) and like books, and can be prepared according to various conventional processes such as an ammoniacal process, a neutral process, an acidic process, etc.

The above-described silver halide emulsion can be chemically sensitized in a conventional manner, if desired. As the chemical sensitizing agent, there can be illustrated, gold compounds such as chloroauric acid salt, auric chloride, etc., as described in U.S. Pat. Nos. 2,399,083, 2,540,085 and 2,597,915, salts of noble metals such as platinum, palladium, iridium, rhodium, ruthenium, etc., as described in U.S. Pat. Nos. 2,448,060, 2,540,086, 2,566,245, 2,566,263 and 2,598,079, sulfur compounds capable of reacting with a silver salt to form silver sulfide as described in U.S. Pat. Nos. 1,574,944, 2,410,689, 3,189,458, 3,501,313, etc., stannous salts as described in U.S. Pat. Nos. 2,487,850, 2,518,698, 2,521,925, 2,521,926, 2,694,637, 2,983,610, 3,201,254, etc., amines and other reducing substances.

The photographic emulsions may, if desired, be subjected to spectral sensitization or supersensitization using cyanine dyes such as cyanine, merocyanine, carbocyanine, etc., dyes, alone or in combination, or further in combination with styryl dyes, etc.

The sensitization/super-sentization dye art is highly developed and blue-sensitive layers are described in, e.g., U.S. Pat. Nos. 2,493,748, 2,519,001, 2,977,229, 3,480,434, 3,672,897, 3,703,377, etc., green-sensitive layers are described in, e.g., U.S. Pat. Nos. 2,688,545, 2,912,329, 3,397,060, 3,615,635, 3,628,964, British Pat. Nos. 1,195,302, 1,242,588, 1,293,862, West German Pat. (OLS) Nos. 2,030,326, 2,121,780, Japanese Patent Publications 4936/68 and 14030/69, etc., and red-sensitive layers are described in Japanese Patent Publication No. 10,773/68, U.S. Pat. Nos. 3,511,664, 3,522,052, 3,527,641, 3,615,613, 3,615,632, 3,617,295, 3,635,721, 3,694,217, British Pat. Nos. 1,137,580, 1,216,203, etc. The dye(s) used can be optionally selected according to the end use of the light-sensitive materials such as the wave-length region to be sensitized, sensitivity and the like.

Various compounds can be added to the above-described photographic emulsion in order to prevent a reduction in sensitivity and the formation of fog in the production, storage or processing of light-sensitive materials formed therefrom. Many compounds are well known for this purpose including many heterocyclic compounds such as 4-hydroxy-6-methyl-1,3,3a,7-tetrazaindene, 3-methylbenzothiazole and 1-phenyl-5-mercaptotetrazole, mercury-containing compounds, mercapto compounds, metal salts, and the like.

Examples of many additional usable compounds are described in Mees; *The Theory of the Photographic Process*, (3rd. ed., 1966), pp. 344–349 citing original literature, and also in U.S. Pat. Nos. 1,758,576, 2,110,178, 2,131,038, 2,173,628, 2,697,040, 2,304,962, 2,324,123, 2,394,198, 2,444,605–8, 2,566,245, 2,694,716, 2,697,099, 2,708,162, 2,728,663-5, 2,476,536, 2,824,001, 2,843,491, 3,052,544, 3,137,577, 3,220,839, 3,226, 231, 3,236,652, 3,251,691, 3,252,799, 3,287,135, 3,326,681, 3,420,668, 3,622,339 and British Pat. Nos. 893,428, 403,789, 1,173,609, and 1,200,188.

The hydrophilic colloid used as a vehicle for the silver halide is conventional. There can be illustrated gelatin, modified gelatin, colloidal albumin, casein, cellulose derivatives (e.g., carboxymethyl cellulose, hydroxyethyl cellulose, etc.), sugar derivatives (e.g., agar-agar, sodium alginate, starch derivatives, etc.), synthetic hydrophilic colloids (e.g., polyvinyl alcohol, poly-N-vinyl pyrrolidone, polyacrylic acid copolymers, polyacrylamide, or derivatives or partially hydrolyzed products thereof). If desired, compatible mixtures of these colloids can also be used.

Each layer of the photographic material can be coated in a conventional manner, e.g., by dip-coating, air knife-coating, curtain coating and extrusion coating using a hopper as described in U.S. Pat. No. 2,681,294.

Two or more layers may be coated, if desired, at the same time as described in, e.g., U.S. Pat. Nos. 2,761,791, 3,508,947, 2,941,898, 3,526,528, etc.

The photographic emulsions are coated on conventional supports which do not undergo serious dimensional changes during processing.

As typical supports, there are a cellulose acetate film, a polystyrene film, a polyethylene terephthalate film, a polycarbonate film, a laminate thereof, paper, baryta paper, paper coated or laminated with a hydrophobic polymer such as polethylene, polypropylene, etc., as are commonly used for photographic light-sensitive materials.

Of these supports, transparent ones are selected for certain end-uses of the light-sensitive material. Also, as is known from J. SMPTE 67, 296 (1958), etc., transparent supports may be colored by adding a dye or a pigment thereto.

Where adhesion between the support and the photographic emulsion layer(s) is insufficient, a subbing layer (an adhesive layer having adhesivity for both the support and the photographic emulsion layer(s) is provided. Also, in order to improve adhesion, the surface of the support may be subjected to a preliminary processing such as a corona discharge, irradiation with ultraviolet rays, flame treatment, etc.

Development processing is necessary after image-wise exposure of the color photographic light-sensitive material of the present invention in order to obtain dye images. Development processing fundamentally involves a color development step, a bleaching step and a fixing step. Each step may be effected independently or two or more steps may be in one processing using a processing solution having a dual function. A mono-bath bleach-fixing solution is one example thereof. Also, each step may be conducted, if desired, by separation into two or more substeps or a combination processing such as color development—first fixing—bleach-fixing may be conducted. Additionally, the development processing step can include, if desired, a hardening, a neutralizing, a first development (black and white development) an image stabilizing, washing and like steps in addition to the above-described steps.

The processing temperature is within a preferred range in a conventional manner depending upon the processing formulation for a light-sensitive material, and a temperature of 18° C. or above is often employed, though temperatures of less than 18° C. are used in some cases. Temperatures of 20° C. to 60° C. and, particularly recently, 30° C. to 60° C., are often employed. Additionally, it is not generally necessary to use the same temperature in all processing steps, though such may be preferred for continuous processing.

In general, the color developer is an aqueous alkaline solution of a pH of 8 or above, preferably 9 to 10, containing a developing agent. The developing agents used are conventional. There can be illustrated 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfoamidoethyl-N,N-diethylaniline, and the salts thereof (e.g., sulfates, chlorides, sulfites, p-toluenesulfonates, etc.) as typical examples. In addition, there are those described in U.S. Pat. Nos. 2,193,015, 2,592,364, Japanese Patent Application (OPI) No. 64933/73, L. F. A. Mason: *Photographic Processing Chemistry* (Focal Press-London, 1966), pp. 226–229, etc. Also, the above-described compounds can be used in combination with 3-pyrazolidones.

Various additives may be added to the color developer, if desired. Typical examples thereof include alkali agents (e.g., hydroxides, carbonates or phosphates of alkali metals or ammonium), pH-adjusting or buffering agents (e.g., weak acids such as acetic acid, boric acid, etc., weak bases and salts thereof), development accelerators (e.g., various pyridinium compounds as described in U.S. Pat. Nos. 2,648,604, 3,671,247, etc., cationic compounds, potassium nitrate, sodium nitrate, polyethylene glycol condensates as described in U.S. Pat. Nos. 2,533,990, 2,577,127, 2,950,970, etc., and derivative thereof, nonionic compounds such as polythioethers as represented by the compounds described in British Pat. Nos. 1,020,033 and 1,020,032, polymeric compounds having a sulfite ester group as represented by the compounds as described in U.S. Pat. No. 3,068,097, organic amines such as pyridine, ethanolamine, etc., benzyl alcohol, hydrazines, and the like, anti-fogging agents (e.g., potassium bromide, potassium iodide, nitrobenzimidazoles as described in U.S. Pat. Nos. 2,496,940 and 2,656,271, mercaptobenzimidazole, 5-methylbenzotriazole, 1-phenyl-5-mercaptotetrazole, compounds as described in U.S. Pat. Nos. 3,113,864, 3,342,596, 3,295,976, 3,615,522, 3,597,199, etc., thiosulfonyl compounds as described in British Pat. No. 972,211, phenazine-N-oxides as described in Japanese Patent Publication No. 41675/71, anti-fogging agents as described in *Kagaku Shashin Binran* (Scientific Photographic Handbook), II, pp. 29–47, etc.), stain- or sludge-preventing agents as described in U.S. Pat. Nos. 3,161,513, 3,161,514, British Pat. Nos. 1,030,442, 1,144,481, 1,251,558, and interimage effect-accelerating agent as described in U.S. Pat. No. 3,536,487, etc., and a preservative (e.g., a sulfite, bisulfite, hydroxylamine hydrochloride, formaldehyde-bisulfite adduct, alkanolamine-bisulfite, etc.).

The light-sensitive material of the present invention is subjected to a conventional bleaching after color development processing. This processing may be conducted simultaneously with or separately from fixing.

To the bleaching solution there may be added, if desired, a fixing agent so that it can be used as a bleach-fixing (blixing) bath. As the bleaching agent, conventional compounds are used. Of these, ferricyanides, dichromates, water-soluble cobalt (III) salts, water-soluble copper (II) salts, water-soluble quinones, nitrosophenols, a complex between a multi-valent metal cation such as iron (III), cobalt (III), copper (II), etc., and an organic acid (e.g., a metal complex of ethylenediaminetetraacetic acid, nitrilotriacetic acid, iminodiacetic acid, N-hydroxyethylenediaminetriacetic acid or a like aminopolycarboxylic acid, malonic acid, tartaric acid, malic acid, diglycolic acid, dithioglycolic acid; 2,6-dipicolinic acid-copper complex; etc.), peracids (e.g., an alkylperacid, persulfate, permanganate, hydrogen peroxide, etc.), a hypochlorite, chlorine, bromine, bleaching powder, and the like are generally used alone or in suitable combination.

To this processing solution can further be added various additives including the bleaching accelerating agents as described in U.S. Pat. Nos. 3,042,520, 3,241,966, Japanese Patent Publications 8506/70 and 8836/70, etc.

EXAMPLE 1

Photographic film A-M were prepared according to the following processes.

1-a Preparation of an emulsion for the less sensitive unit emulsion layer

A silver bromoiodide emulsion (mean grain size: 0.45μ; content of silver halide: 100 g/Kg emulsion; content of gelatin: 70 g/Kg emulsion) containing 6 mol% iodide was prepared in a conventional manner. To 1 Kg of this emulsion were added 200 cc of a 0.1% by weight methanol solution of 5,5'-diphenyl-3,3'-di-(2-sulfoethyl)-9-ethylbenzoxacarbocyanine pyridinium salt as a green-sensitive color sensitizing agent, and then 20 cc of a 5% by weight aqueous solution of 4-hydroxy-6-methyl-1,3,3a,7-tetrazaindene. Then, 400 g of Emulsion (1) having the following formulation and, as a gelatin-hardening agent, 50 cc of a 2% by weight aqueous solution of 2-hydroxy-4,6-dichlorotriazine sodium salt were added in sequence thereto to prepare an emulsion for the less sensitive unit emulsion layer.

Emulsion (1)

| | | |
|---|---|---|
| (i) | 10% by weight gelatin aqueous solution | 1,000 g |
| (ii) | Sodium p-Dodecylbenzenesulfonate | 5 g |
| | Tricresyl Phosphate | 65 cc |
| | Magenta Coupler (1) | 60 g |
| | DIR Magenta Coupler (2) | 3 g |
| | Ethyl Acetate | 110 cc |

The mixture of (ii) was dissolved at 55° C., and added to (i) which had been previously heated to 55° C., followed by emulsifying using a colloid mill.

Magenta coupler (1):

1-(2,4,6-Trichlorophenyl)-3-[3-(2,4-di-t-pentylphenoxyacetamido)benzamido]-5-pyrazolone DIR Magenta coupler (2):

1-{4-[2-(2,4-di-t-pentylphenoxy)butanamido]phenyl}-3-(1-pyrrolidinyl)-4-(1-phenyltetrazol-5-thio)-5-pyrazolone

1-b. Preparation of an emulsion for the more sensitive unit emulsion layer

A silver bromoiodide emulsion (mean grain size: 0.9μ; content of silver halide: 100 g/l Kg emulsion; content of gelatin: 70 g/l Kg emulsion) containing 6 mol% iodide was prepared in a conventional manner. To 1 Kg of this emulsion were added 80 cc of a 0.1% by weight methanol solution of the green-sensitive color sensitizing agent given in 1-a and 20 cc of a 5% by weight aqueous solution of 4-hydroxy-6-methyl-1,3,3a,7-tetrazaindene. Then, a coupler solution comprising emulsion (2) or (3) in accordance with the following formulation (2) or (3) and a 4.3% by weight aqueous alkali solution of coupler (M-1) was added according to Table 1, and 50 cc of a 2% by weight aqueous solution (solution of gelatin hardening agent) of 2-hydroxy-4,6-dichlorotriazine sodium salt was added thereto to prepare an emulsion for the more sensitive unit emulsion layer.

Emulsion (2)

| | |
|---|---|
| (i) 10% by weight gelatin aqueous solution | 1,000 g |
| (ii) Sodium p-Dodecylbenzenesulfonate | 5 g |
| Tricresyl Phosphate | 65 cc |
| Magenta coupler (1) | 63 g |
| Ethyl Acetate | 110 cc |

Emulsion (3)

Prepared in the same manner as with emulsion (1) except for changing the amounts of couplers as follows.

| | |
|---|---|
| Magenta coupler (1) | 6 g |
| DIR Magenta coupler (2) | 60 g |

With emulsions (1), (2) and (3), the total amounts of couplers were adjusted to be equimolar.

1-c Preparation of a green-sensitive film

On a cellulose triacetate base were coated, in sequence, the less sensitive unit emulsion layer, the more sensitive unit emulsion layer (both in the silver amounts given in Table 1), and a protective layer (in a dry thickness of 1μ).

The thus obtained green-sensitive films A–M were step-wise exposed to green light, and subjected to the following development processing. The results are shown in Table 2.

| Processing Step | Temperature | Time |
|---|---|---|
| Color Development | 38° C. | 3 min. |
| Stopping | " | 1 |
| Washing | " | 1 |
| Bleaching | " | 2 |
| Washing | " | 1 |
| Fixing | " | 2 |
| Washing | " | 1 |
| Stabilizing | " | 1 |

The processing solutions used had the following compositions.

| | |
|---|---|
| Color Developer | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Disodium Ethylenediaminetetraacetate Dihydrate | 2 g |
| 4-Amino-3-methyl-N-ethyl-N-(β-hydroxyethyl)aniline Monosulfate | 4 g |
| Water to make the total | 1 liter |
| Stopping Bath | |
| Sodium Thiosulfate | 10 g |
| Ammonium Thiosulfate (70% aqueous solution) | 30 ml |
| Acetic Acid | 30 ml |
| Sodium Acetate | 5 g |
| Potash Alum | 15 g |
| Water to make the total | 1 liter |
| Bleaching Solution | |
| Fe(III)-ethylenediaminetetraacetic acid (Na) complex salt(Dihydrate) | 100 g |
| Potassium Bromide | 50 g |
| Ammonium Nitrate | 50 g |
| Boric Acid | 5 g |
| Aqueous Ammonia to adjust the pH to 5.0 | |
| Water to make the total | 1 liter |
| Fixing Solution | |
| Sodium Thiosulfate | 150 g |
| Sodium Sulfite | 15 g |
| Boric Acid | 12 g |
| Glacial Acetic Acid | 15 ml |
| Potash Alum | 20 g |
| Water to make the total | 1 liter |
| Stabilizing Bath | |
| Boric Acid | 5 g |
| Sodium Citrate | 5 g |
| Sodium Metaborate (tetrahydrate) | 3 g |
| Potash Alum | 15 g |
| Water to make the total | 1 liter |

The composition of the emulsion layer of the films and the results of the photographic properties and graininess are tabulated in Table 2. The films showed a good linear property (γ÷0.7).

Table 1

| | Coupler Dispersion of the more sensitive emulsion layer | | | Coupler Composition of the more sensitive unit emulsion layer | | |
|---|---|---|---|---|---|---|
| Film | Solution of M-1 | Emulsion (3) | Emulsion (2) | M-1 | DIR coupler | Magenta coupler (1) |
| A | — | — | 200 g | — | — | 100 mol% |
| B | 20 g | — | 180 g | 10 mol% | — | 90 mol% |
| C | 40 g | — | 160 g | 20 mol% | — | 80 mol% |
| D | 100 g | — | 100 g | 50 mol% | — | 50 mol% |
| E | 140 g | — | 60 g | 70 mol% | — | 30 mol% |
| F | 180 g | — | 20 g | 90 mol% | — | 10 mol% |
| G | 200 g | — | — | 100 mol% | — | — |
| H | — | 20 g | 180 g | — | 9 mol% | 91 mol% |
| I | 20 g | 20 g | 160 g | 10 mol% | 9 mol% | 81 mol% |
| J | 40 g | 20 g | 140 g | 20 mol% | 9 mol% | 71 mol% |
| K | 100 g | 20 g | 80 g | 50 mol% | 9 mol% | 41 mol% |
| L | 140 g | 20 g | 40 g | 70 mol% | 9 mol% | 21 mol% |
| M | 180 g | 20 g | — | 90 mol% | 9 mol% | 1 mol% |

Table 2

| Film | Coated Silver Amount (mg/dm²) More Sensitive Layer | Less Sensitive Layer | Photographic Property Fog | Relative Sensitivity | Graininess (R.M.S.) (D = 0.6)* | Note |
|---|---|---|---|---|---|---|
| A | 12 | 17 | 0.06 | 0 | 0.080 | More |
| B | 12 | 17 | 0.08 | +0.05 | 0.075 | sensitive |
| C | 12 | 17 | 0.10 | +0.05 | 0.070 | layer did |
| D | 12 | 17 | 0.12 | +0.07 | 0.065 | not con- |
| E | 12 | 17 | 0.15 | +0.08 | 0.065 | tain DIR |
| F | 12 | 17 | 0.27 | +0.09 | 0.065 | coupler |
| G | 12 | 17 | 0.28 | +0.10 | 0.065 | |
| H | 17 | 17 | 0.05 | −0.02 | 0.055 | More |
| I | 17 | 17 | 0.06 | 0.03 | 0.050 | sensitive |
| J | 17 | 17 | 0.07 | 0.04 | 0.045 | layer |
| K | 17 | 17 | 0.10 | 0.06 | 0.045 | contained |
| L | 17 | 17 | 0.12 | 0.07 | 0.050 | DIR |
| M | 17 | 17 | 0.24 | 0.07 | 0.055 | coupler |

*D represents optical density

As is clear from the results given in Tables 1 and 2, films B–E containing rapid coupling magenta coupler M-1 and slow coupling coupler emulsion (2) or (3) in the more sensitive unit emulsion layer coated on the common less sensitive unit emulsion layer (the content of the slow coupling coupler in the coupler emulsion: 30–90 mol%) are excellent in relative sensitivity and graininess. On the other hand, as with films H–M, the effects of the present invention are increased by replacing part of the slow coupling coupler by a DIR coupler. When a DIR coupler was added to the more sensitive unit emulsion layer in an amount of 9 mol%, particularly excellent results were obtained with films I–L in which the proportion of the slow coupling coupler was 21–81 mol%.

As a result of conducting experiments variously changing the added amount of DIR coupler, it was found that no effect resulted when the amount was less than 0.1 mol%, while, when the amount was more than 40 mol%, maximum image density was low and sensitivity was reduced.

EXAMPLE 2

On a support were coated, in sequence, a red-sensitive layer, the green-sensitive layer described in Example 1 and a blue-sensitive layer in a manner analogous to Example 1, and the resulting material was subjected to the same development processing as in Example 1. As a result, there were obtained almost parallel results with respect to the relative sensitivity and the effect of improving graininess.

EXAMPLE 3

The same procedures as in Example 1 were followed except for the following points. The green-sensitive layer was separated into a more sensitive unit emulsion layer, a middle sensitive unit emulsion layer and a less sensitive unit emulsion layer. The most sensitive unit emulsion layer was the same as in A–M in Example 1. The middle sensitive unit emulsion layer was prepared by adding 300 g of Emulsion (1) (obtained by adding the same additives as with the less sensitive emulsion layer in Example 1 in the same amounts as set forth in Example 1) to a silver bromoiodide emulsion (mean grain size: 0.6μ: content of silver halide: 100 g/1 kg emulsion; content of gelatin: 70 g/1 Kg emulsion) containing 6 mol% iodide in the following amounts. The less sensitive unit emulsion layer was prepared in the same manner as with the less sensitive unit emulsion layer in Example 1 except for using silver halide grains of 0.35μ in mean grain size, adding the aforesaid sensitizing dye in a 1.5-fold amount and adding 500 g of emulsion (1) and 20 g of emulsion (3).

The same exposure and the same processing as in Example 1 were conducted to obtain the following results set forth in Table 3.

Table 3

| Film | Slow Coupling Coupler/ Rapid Coupling Coupler (molar %) | Coated Silver Amount (mg/dm²) More Sensitive Layer | Middle Sensitive Layer | Less Sensitive Layer | Photographic Property Fog | Relative Sensitivity | Graininess (R.M.S.) (D = 0.6) | Note |
|---|---|---|---|---|---|---|---|---|
| A³ | 100 | 10 | 10 | 9 | 0.07 | 0 | 0.07 | More sensitive |
| B³ | 90 | 10 | 10 | 9 | 0.09 | 0.05 | 0.065 | layer did |
| C³ | 80 | 10 | 10 | 9 | 0.10 | 0.05 | 0.060 | not contain |
| D³ | 50 | 10 | 10 | 9 | 0.13 | 0.06 | 0.060 | DIR coupler |
| E³ | 30 | 10 | 10 | 9 | 0.16 | 0.07 | 0.050 | |
| F³ | 10 | 10 | 10 | 9 | 0.29 | 0.09 | 0.050 | |
| G³ | 0 | 10 | 10 | 9 | 0.30 | 0.09 | 0.055 | More sensitive layer did not contain DIR coupler |
| H³ | 91 | 13 | 10 | 9 | 0.05 | −0.02 | 0.050 | More sensitive |
| I³ | 81 | 13 | 10 | 9 | 0.07 | 0.02 | 0.045 | layer contained |
| J³ | 71 | 13 | 10 | 9 | 0.07 | 0.04 | 0.045 | DIR coupler |
| K³ | 41 | 13 | 10 | 9 | 0.11 | 0.05 | 0.040 | |
| L³ | 21 | 13 | 10 | 9 | 0.13 | 0.07 | 0.040 | |

Table 3-continued

| Film | Slow Coupling Coupler/ Rapid Coupling Coupler (molar %) | Coated Silver Amount (mg/dm²) More Sensitive Layer | Middle Sensitive Layer | Less Sensitive Layer | Photographic Property Fog | Relative Sensitivity | Graininess (R.M.S.) (D = 0.6) | Note |
|---|---|---|---|---|---|---|---|---|
| $M^3$ | 1 | 13 | 10 | 9 | 0.25 | 0.07 | 0.045 | |

As compared with the films of a mol% outside the above-described range, there resulted less fog, a fine graininess and less reduction in sensitivity. On the other hand, when part of the slow coupling coupler was replaced by a DIR coupler, the effects became more remarkable, and, with films $I^3$–$L^3$ containing 21–81 mol% of the slow coupling coupler (provided that the DIR coupler was present in proportion of 9 mol%), the above-described effects were enhanced.

EXAMPLE 4

The same procedures as in Example 1 were conducted except for using emulsion (2) in place of emulsion (1) as an emulsion for the less sensitive unit emulsion layer and removing the DIR coupler from the less sensitive unit emulsion layer.

Table 4

| Film | Slow Coupling Coupler/ Rapid Coupling Coupler (mol %) | Coated Silver Amount (mg/dm²) More Sensitive Layer | Less Sensitive Layer | Photographic Property Fog | Relative Sensitivity | Graininess (R.M.S.) (D = 0.6) | Note |
|---|---|---|---|---|---|---|---|
| $A^4$ | 100 | 10 | 10 | 0.06 | 0 | 0.095 | More |
| $B^4$ | 90 | 10 | 10 | 0.08 | 0.05 | 0.090 | sensitive |
| $C^4$ | 80 | 10 | 10 | 0.11 | 0.05 | 0.085 | layer did |
| $D^4$ | 50 | 10 | 10 | 0.13 | 0.07 | 0.080 | not contain |
| $E^4$ | 30 | 10 | 10 | 0.16 | 0.07 | 0.080 | DIR coupler |
| $F^4$ | 10 | 10 | 10 | 0.29 | 0.09 | 0.080 | |
| $G^4$ | 0 | 10 | 10 | 0.30 | 0.10 | 0.080 | |
| $H^4$ | 91 | 13 | 10 | 0.06 | −0.01 | 0.075 | More |
| $I^4$ | 81 | 13 | 10 | 0.06 | 0.03 | 0.070 | sensitive |
| $J^4$ | 71 | 13 | 10 | 0.08 | 0.03 | 0.070 | layer |
| $K^4$ | 41 | 13 | 10 | 0.11 | 0.06 | 0.065 | contained |
| $L^4$ | 21 | 13 | 10 | 0.13 | 0.07 | 0.065 | DIR coupler |
| $M^4$ | 1 | 13 | 10 | 0.24 | 0.07 | 0.065 | |

The results given in Table 4 were obtained. Similarly to Examples 1–3, excellent effects were obtained with films $B^4$–$E^4$ containing 30–90 mol% of the slow coupling coupler in the more sensitive unit emulsion layer. More excellent effects were obtained with films $I^4$–$L^4$ containing 9 mol% of the DIR coupler and 21–81 mol% of the slow coupling coupler.

In this Example, graininess and anti-fogging property were somewhat inferior since the less sensitive unit emulsion layer did not contain the DIR coupler.

While the invention has been described in detail and with reference to specific embodiments thereof, it will be apparent to one skilled in the art that various changes and modifications can be made therein without departing from the spirit and scope thereof.

What is claimed is:

1. A multi-layer color light-sensitive material comprising at least one silver halide emulsion layer which comprises at least two unit emulsion layers, one of which is a relatively more sensitive unit emulsion layer and one of which is a relatively less sensitive unit emulsion layer, the at least two unit emulsion layers being sensitive to the same spectral region, wherein the less sensitive unit emulsion layer contains a slow coupling coupler and the more sensitive unit emulsion layer contains a rapid coupling coupler and a slow coupling coupler in an amount of from about 20 to about 90 mol% based on the total coupler amount in the more sensitive unit emulsion layer, where the less sensitive unit emulsion layer and/or the more sensitive unit emulsion layer further contains a development inhibitor-releasing (DIR) coupler and/or a development inhibitor-releasing (DIR) compound in an amount of from about 0.1 to about 40 mol% based on the total coupler amount in the more sensitive unit emulsion layer and/or the less sensitive unit emulsion layer, said development inhibitor-releasing (DIR) coupler being represented by general formulae (VII), (VIII) or (IX):

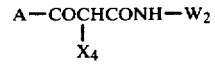

wherein A represents an aryl group, a tert-alkyl group or a substituted 1,1-dialkylmethyl group, $W_2$ represents a substituted aryl group, and $X_4$ represents a group eliminated upon coupling to diffuse as a development inhibitor;

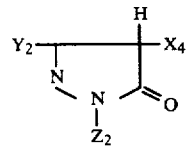

(VIII)

wherein $Y_2$ represents an alkyl group or a substituted amino group, $Z_2$ represents an aryl group, a substituted aryl group, an aralkyl group or a substituted aralkyl group and $X_4$ represents a group eliminated upon coupling to diffuse as a development inhibitor; and

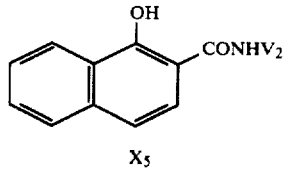

(IX)

wherein $V_2$ represents a substituted aryl group, a substituted aryloxy alkyl group or an alkyl group and $X_5$ represents a group capable of being eliminated upon coupling to diffuse as a development inhibitor.

2. A multi-layer color light-sensitive material as claimed in claim 1, wherein the difference in sensitivity between the more sensitive unit emulsion layer and the less sensitive unit emulsion layer ranges from about 0.1 to about 0.7 log E.

3. A multi-layer color light-sensitive material as claimed in claim 1, wherein the molar ratio of silver halide/coupler ranges from about 2 to about 100 in the more sensitive unit emulsion layer and from about 3 to about 30 in the less sensitive unit emulsion layer.

4. A multi-layer color light-sensitive material as claimed in claim 1, wherein the less sensitive unit emulsion layer and the more sensitive unit emulsion layer both contain a development inhibitor-releasing (DIR) coupler.

5. A multi-layer color light-sensitive material as claimed in claim 1, wherein the less sensitive unit emulsion layer and the more sensitive unit emulsion layer both contain a development inhibitor-releasing (DIR) compound.

6. A multi-layer color light-sensitive material as claimed in claim 1, wherein the less sensitive unit emulsion layer or the more sensitive unit emulsion layer contains a development inhibitor-releasing (DIR) coupler.

7. A multi-layer color light-sensitive material as claimed in claim 1, wherein the less sensitive unit emulsion layer or the more sensitive unit emulsion layer contains a development inhibitor-releasing (DIR) compound.

8. A multi-layer color light-sensitive material as claimed in claim 1, wherein the coupling velocity of the rapid coupling coupler is about 2 to about 20 times that of the slow coupling coupler.

9. A multi-layer color light-sensitive material as claimed in claim 1, wherein the coupling velocity of the rapid coupling coupler is 3 to 5 times that of the slow coupling coupler.

10. A multi-layer color light-sensitive material as claimed in claim 1, wherein the development inhibitor-releasing (DIR) coupler forms substantially the same hue as that of the rapid coupling coupler or slow coupling coupler in the unit emulsion layer therewith.

11. A multi-layer color light-sensitive material as claimed in claim 1 wherein said slow coupling coupler is present in an amount of from about 30 to about 80 mol% based on the total coupler amount in the more sensitive unit emulsion layer.

12. A multi-layer color light-sensitive material as claimed in claim 1 comprising at least three of said silver-halide emulsion layers comprising a relatively more sensitive unit emulsion layer and a relatively less sensitive unit emulsion layer, which silver-halide emulsion layers provide cyan, magenta and yellow dye images.

13. A multi-layer color light-sensitive material as claimed in claim 1 wherein said (DIR) compound is a DIR hydroquinone.

14. A multi-layer color light-sensitive material as claimed in claim 1 wherein $W_2$ is a substituted phenyl group and the substituent for $W_2$ is a halogen atom, an alkoxy group, a sulfo group, a carboxy group or an alkoxy carbonyl group.

15. A multi-layer color light-sensitive material as claimed in claim 1 wherein $Y_2$ is substituted phenyl amino or naphthyl amino.

16. A multi-layer color light-sensitive material as claimed in claim 1 wherein $Z_2$ is a substituted phenyl group wherein the substituent is halogen, acylamino, sulfamoyl or carbamoyl.

17. A multi-layer color light-sensitive material as claimed in claim 1 wherein $Z_2$ is a substituted aralkyl group wherein the substituent is an alkyl group, an alkoxy group or a halogen atom.

18. A multi-layer color light-sensitive material as claimed in claim 1 wherein $V_2$ is a substituted aryl group, wherein the aryl group is phenyl or naphthyl and the substituent is an alkoxy or an alkyl group.

19. A multi-layer color light-sensitive material as claimed in claim 1 wherein $V_2$ is a substituted aryloxyalkyl group where the aryl moiety is phenyl, the alkyl moiety has from 2 to 6 carbon atoms and the substituent is an alkoxy group or an alkyl group.

20. A multi-layer color light-sensitive material as claimed in claim 1, wherein said rapid coupling coupler is selected from the class consisting of:

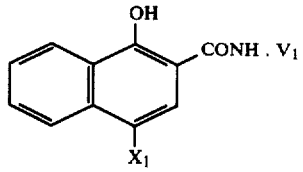

wherein $X_1$ represents a hydrogen atom, an alkoxy group which is acyl, fluorine, chlorine or amino substituted, or an aryloxy group which is substituted with a photographically inert substituent, $V_1$ represents an acylamino substituted alkyl group or a phenyl group of the formula:

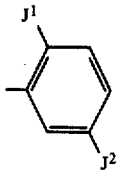

wherein $J^1$ represents a dialkylamino group, a halogen atom or an alkoxy group, $J^2$ represents a sulfo group, an N-alkylsulfamoyl group, a carboxy group or an alkoxycarbonyl group when $X_1$ represents a hydrogen atom, or $V_1$ represents an alkyl group or an aryloxyalkyl group when $X_1$ represents a substituted alkoxy group or a substituted aryloxy group as described;

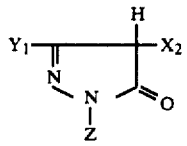

wherein $X_2$ represents a hydrogen atom or a hydroxyphenylazo group, $Z_1$ represents a substituted phenyl group free of substituents at the 2- and 6-positions, which is substituted with halogen, an alkyl group with from 1 to 5 carbon atoms or an alkoxy group with 1 to 5 carbon atoms, provided that when $X_2$ represents a hydroxyphenylazo group $Z_1$ can be a phenyl group which is substituted at the 2- and/or 6-positions, wherein said substituent(s) is/are selected from the group consisting of halogen, an alkyl group with 1 to 5 carbon atoms and an alkoxy group with 1 to 5 carbon atoms, and Y represents an alkyl group, an acylamino group or a substituted phenyl amino group wherein the substituent is selected from the group consisting of halogen, acylamino, sulfamoyl and carbamoyl;

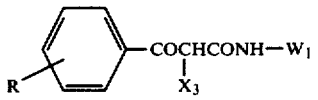

wherein $X_3$ represents a hydrogen atom or a cyclic amido group, R represents an alkyl group or an alkoxy group, and $W_1$ represents a disubstituted phenyl group of the formula:

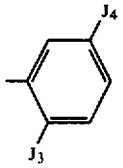

wherein $J_3$ represents a halogen atom or an alkoxy group and $J_4$ represents a sulfo group, a carboxy group or an alkoxycarbonyl group, or, when $X_3$ represents a cyclic amido group, $J_4$ is an acylamino group.

21. A multi-layer color light-sensitive material as claimed n claim 20, wherein said slow coupling coupler is selected from the group consisting of:

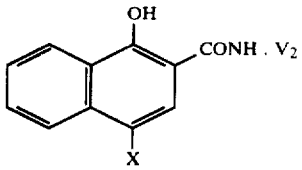

wherein $V_2$ represents an alkyl group or an aryloxyalkyl group and X represents a hydrogen atom or a halogen atom;

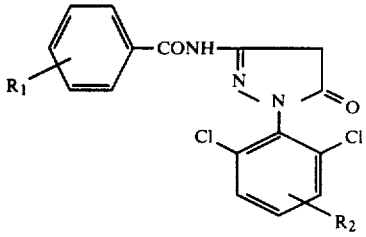

wherein $R_2$ represents a halogen atom, a lower alkyl group or a lower alkoxy group, and $R_1$ represents an alkyl group, an aryloxyalkylcarbamido group or an alkylamido group; and

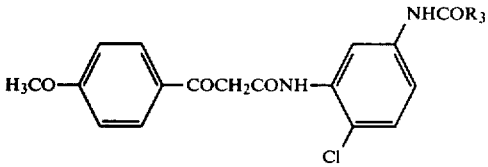

wherein $R_3$ represents an alkyl group or an aryloxyalkyl group.

22. A multi-layer color light-sensitive material comprising at least one silver halide emulsion layer which comprises at least two unit emulsion layers, one of which is a relatively more sensitive unit emulsion layer and one of which is a relatively less sensitive unit emulsion layer, the at least two unit emulsion layers being sensitive to the same spectral region, wherein the less sensitive unit emulsion layer contains a slow coupling coupler and the more sensitive unit emulsion layer contains a rapid coupling coupler and a slow coupling coupler in an amount of from about 20 to about 90 mol% based on the total coupler amount in the more sensitive unit emulsion layer, where the less sensitive unit emulsion layer and/or the more sensitive unit emulsion layer further contains a development inhibitor-releasing (DIR) coupler and or a development inhibitor-releasing (DIR) compound in an amount of from about 0.1 to about 40 mol% based on the total coupler amount in the more sensitive unit emulsion layer and/or the less sensitive unit emulsion layer, said development inhibitor-releasing (DIR) compound being a DIR hydroquinone.

* * * * *